United States Patent [19]

Johnson et al.

[11] 4,185,442

[45] Jan. 29, 1980

[54] REEL CHANGING DEVICE FOR WRAPPING MACHINES

[75] Inventors: Reginald F. Johnson, Lea, near Gainsborough; Ronald Cawte, Gainsborough, both of England

[73] Assignee: Baker Perkins Holdings Limited, Peterborough, England

[21] Appl. No.: 909,676

[22] Filed: May 25, 1978

[30] Foreign Application Priority Data

Nov. 28, 1977 [GB] United Kingdom ..... 49437/77

[51] Int. Cl.[2] ..... B65B 41/16; B65B 41/12

[52] U.S. Cl. ..... 53/168; 53/389; 242/58.6

[58] Field of Search ..... 53/389, 234, 172, 211, 53/168, 228; 242/55.42, 58.6, 78.6, 78.7; 226/108

[56] References Cited

U.S. PATENT DOCUMENTS

| | | | |
|---|---|---|---|
| 2,946,167 | 7/1960 | Clemens | 53/389 X |
| 3,325,071 | 6/1967 | Schmitz | 53/172 X |
| 3,478,974 | 11/1969 | Roscoe et al. | 242/58.6 X |
| 3,546,850 | 12/1970 | Hatanaka et al. | 242/55.42 X |
| 4,075,815 | 2/1978 | Carver, Jr. et al. | 53/228 X |

*Primary Examiner*—Horace M. Culver

*Attorney, Agent, or Firm*—Watson, Cole, Grindle & Watson

[57] ABSTRACT

A wrapping machine having feed rollers for introducing a web of wrapping material into a wrapping mechanism and including a reel changing device comprising a support mounted on the machine frame, mountings on the support for two reels of wrapping material, guiding means on the support for guiding the webs from the two reels to respective separate draw-off points, the support being movable with respect to the machine frame between alternative positions, in one of which the draw-off point of one web is close to the feed rollers and in the other of which the draw-off point of the other web is close to the feed rollers, and means for locking the support to the machine frame in each of its two alternative positions, the mountings for the reels and the guiding means for the reels being so disposed that, when one reel is feeding wrapping material, a replacement reel placed on the other mounting is accessible to enable the web thereon to be fed through its guiding means to its draw-off point.

5 Claims, 4 Drawing Figures

REEL CHANGING DEVICE FOR WRAPPING MACHINES

In machines for wrapping mass-produced articles, e.g. sweets, wherein a web of wrapping material is fed from a reel, it is conventional, upon expiry of a reel, to stop the machine in order to replace it by a new reel and thread-up the web from the new reel. This periodic interruption of the operation of the machine for a time dependent upon the skill of the operator, and upon the type of sweets to be wrapped, can result in an undue loss of production. Thus, for example, when wrapping sweets of the bubble-gum type it is usual to include a printed "picture strip" and either a plain or printed outer wrapper in the wrapping of the sweet. The outer wrapper and "picture strip" are usually supplied as a single web, which, as it is drawn from the reel, is fed between a pair of rotary cutting rollers which sever the web longitudinally to split it into the "picture strip" and an outer wrapper strip. The outer strip passes around guide rollers towards the nip of a pair of feed rollers whilst the "picture strip" is temporarily diverted away from the outer strip to pass into contact with a folder blade which folds this strip longitudinally, the folded strip then passing over guide rollers which guide it into contact with the outer strip as it passes into the nip of the feed rollers. The threading-up of such a web is often a long and tedious operation.

The loss of production involved by such rethreading is serious in a modern sweet wrapping machine which wraps at high speed, e.g. 1200 sweets per minute, and is involved many times during a day's production run since a web runs out after 20 minutes or so.

It has been proposed to overcome this difficulty by providing a device for splicing the web from a replacement reel on to the expiring web from the reel in use but such devices are cumbersome and prone to malfunction due to their complicated construction.

It is the object of the invention to provide a reel changing device which is simple in operation and which can be carried out by an operator without undue loss of time during the changeover period.

The invention accordingly provides a wrapping machine having feed rollers for introducing a web of wrapping material into a wrapping mechanism and including a reel changing device comprising a support mounted on the machine frame, mountings on the support for two reels of wrapping material, guiding means on the support for guiding the webs from the two reels to respective separate draw-off points, the support being movable with respect to the machine frame between alternative positions, in one of which the draw-off point of one web is close to the feed rollers and in the other of which the draw-off point of the other web is close to the feed rollers, and means for locking the support to the machine frame in each of its two alternative positions, the mountings for the reels and the guiding means for the reels being so disposed that, when one reel is feeding wrapping material, a replacement reel placed on the other mounting is accessible to enable the web thereon to be fed through its guiding means to its draw-off point.

The time involved in changing reels is thus reduced to a minimum. When the machine stops as the result of exhaustion of a web, it is only necessary for the operator to unlock the support, move it to its alternative position to bring the web from the replacement reel, which has been threaded to its draw-off point during the feeding of the web which has just been exhausted, adjacent the feed rollers, relock the support and introduce the end of the new web into the feed rollers. This can be accomplished in a few seconds.

Preferably the support is a turret, rotatably mounted on the machine frame, e.g. for rotation about a vertical axis.

Two embodiments of the invention will now be described by way of example with reference to the accompanying drawings, in which.

Figure 1:
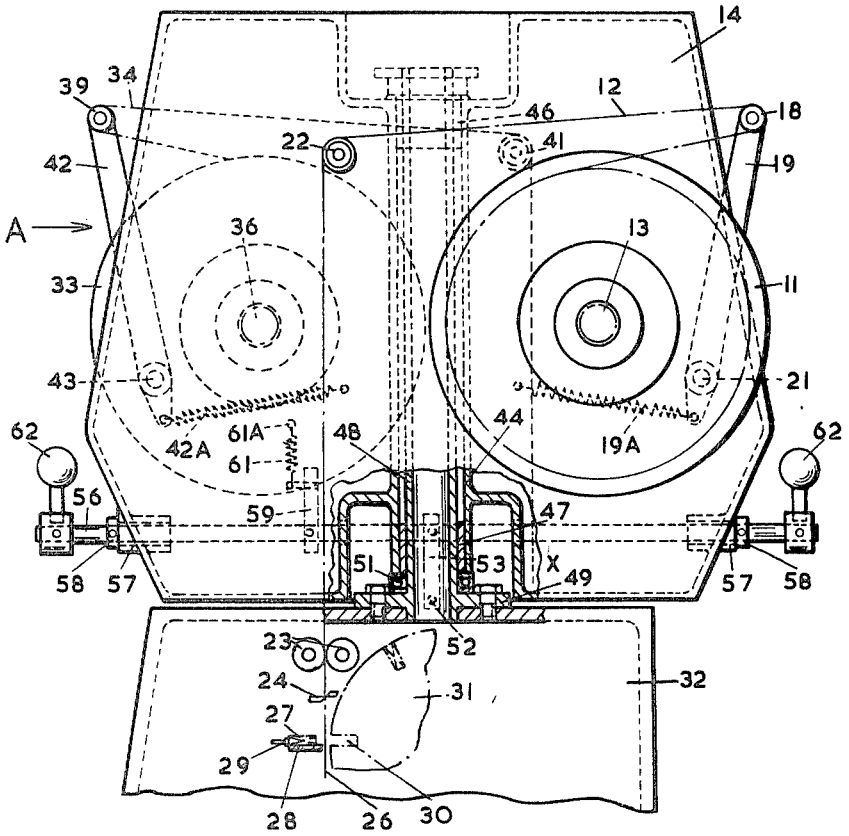
FIG. 1 is an elevation, drawn partly in section, illustrating the first embodiment.
Figure 2:
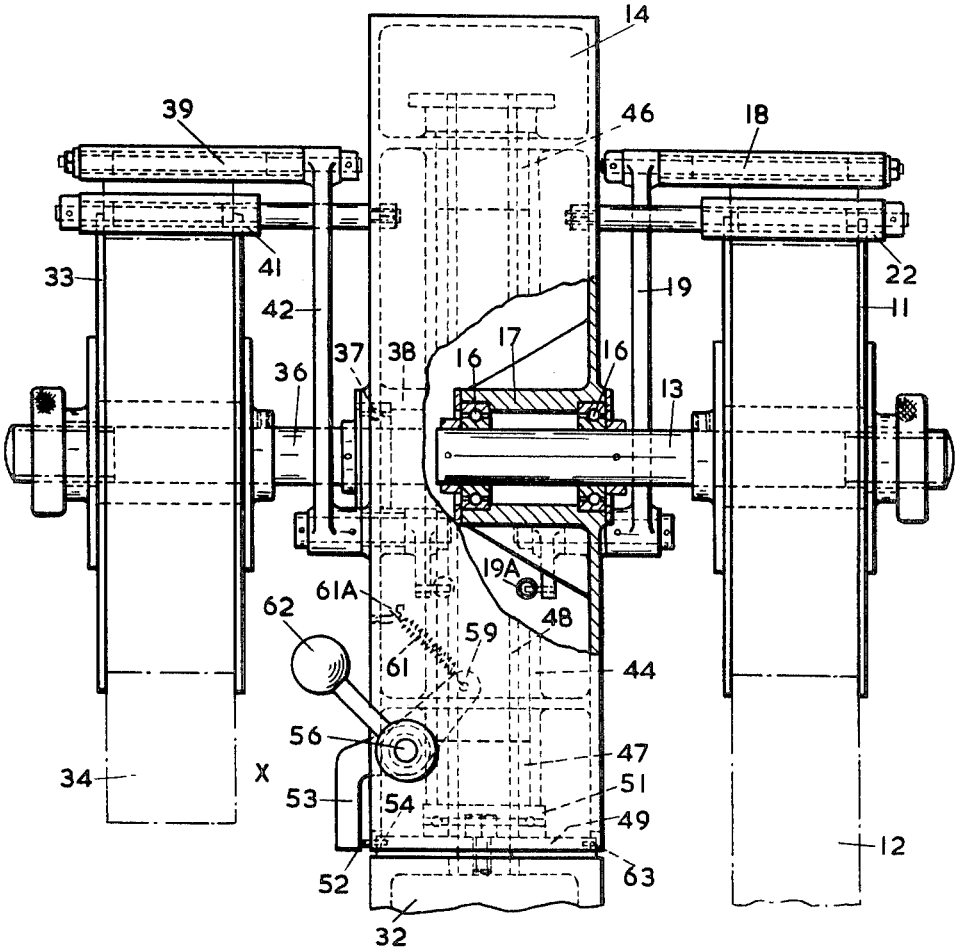
FIG. 2 is an end elevation, drawn partly in section, viewed in the direction of arrow 'A' in FIG. 1.

In the embodiment shown in FIGS. 1 and 2, a reel 11 carrying a web 12 of wrapping material is mounted on a shaft 13 which extends from one side of a support 14 and is rotatably mounted in bearings 16 secured in a housing 17 formed in the support 14. The web 12 passes from the reel 11 over a tension roller 18, freely mounted on an arm 19 pivotally mounted at 21 on the support 14 and urged by a spring 19A about its pivot in the direction to cause the roller 18 to tension the web 12, and a guide roller 22, rotatably mounted on the support 14, to the nip of a pair of driven feed rollers 23, which feed the web 12 towards a cutting device 24 which severs successive portions from the web 12 to form wrappers 26 in which successive sweets 27 are wrapped.

The wrapping of each sweet 27 is initiated by transfer of the sweet 27 from a support 28 by a pusher 29 into a waiting pocket 30 formed in a wrapping wheel 31 mounted for intermittent rotation in the machine frame 32. During such transfer the wrapper 26 is folded about the sweet on three sides, completion of the wrapping operation being performed during further rotation of the wrapping wheel 31 in the conventional manner.

A stand-by reel 33 carrying a web 34 of wrapping material is mounted on another shaft 36 extending from the opposite side of the support 14 to the shaft 13, the shaft 36 being laterally offset from the shaft 13 and mounted in bearings 37 (only one of which is shown in FIG. 2) secured in a housing 38 formed in the support 14. The web 34 from the reel 33 is threaded over a tension roller 39 and left hanging downwardly over a rotatable guide roller 41 as shown in chain line in FIG. 1, the leading end of the web 34 being positioned at a draw-off point X adjacent the base of the support 14. The tension roller 39 is freely mounted on an arm 42 pivotally mounted at 43 on the support 14 and urged by a spring 42A about its pivot in the direction to cause the roller 39 to tension the web 34.

The support 14 includes a central hub 44 supported by upper and lower bearings 46 and 47, respectively, on a tubular spigot 48 formed at its lower end with a flange 49 secured to the frame 32. The lower face of the hub 44 rests on a thrust bearing 51 supported on the upper surface of the flange 49, the lower surface of the support 14 being clear of the upper surface of the frame 32 so that the support 14 is capable of rotation on the spigot 48.

The support 14 is located and secured in a position such that the web 12 passes from the guide roller 22 into the feed rollers 23, as mentioned above, by engagement of a peg 52, secured to an arm 53, in an aperture 54 in the flange 49 as shown in FIG. 2. The arm 53 is secured to a shaft 56 mounted in bearings 57 at opposite ends of the support 14, the shaft 56 carrying collars 58 which retain it in correct alignment in the support 14. Also secured to the shaft 56 is another arm 59 and a spring 61 extends between the arm 59 and a hook 61$^{A}$ on the support 14. The spring 61 urges the peg 52 into the aperture 54 to lock the support 14 against rotational movement during operation of the machine. The ends of the shaft 56 extend outwardly from the support 14 and carry hand knobs 62.

When the web 12 supplied from the reel 11 has been used up, the machine is automatically stopped. This is effected in well known manner by a microswitch (not shown) associated with the guide roller 22 which operates to stop the machine when it loses contact with the web 12 drawn from the reel 11. Due to its inertia, the machine uses up the tail end of the web 12 between the roller 22 and the feed rollers 23. A similar microswitch (also not shown) is associated with the guide roller 41 and operates to stop the machine upon exhaustion of the web 34 from the stand-by reel 33, when this is in use as explained below. If preferred, however, the machine-stopping switches may be located further back and associated with the reels 12, 33 themselves, the tail ends of the exhausted webs being cut off and discarded.

Immediately after the machine has stopped, the peg 52 is released manually from engagement with the aperture 54 by rotating the shaft 56 by means of one of the hand knobs 62, the support 14 is then rotated manually through 180° and the hand knob 62 is released to allow the peg 52, under the influence of the spring 61, to engage another aperture 63 (FIG. 2) in the flange 49 to lock the support 14 to the machine frame 32. This brings the leading edge of the web 34 from the stand-by reel 33 into alignment with the feed rollers 23 and this leading edge is immediately threaded by the operator into the feed rollers 23, whereupon the machine is switched on again to allow wrapping of the sweets to continue. During the continued wrapping operation, the operator can remove the core of the exhaust reel 11 from the spindle 13, clamp a new reel on to the spindle 13, thread the web from the new reel over the rollers 18 and 22, and draw the leading edge of this web downwardly to the draw-off position X in readiness for the next reel changing operation.

As will be appreciated, apparatus of the kind just described can also be used for wrapping of sweets of the bubble-gum type by providing, in association with each reel, a separate web-severing, strip folding and strip guiding mechanism of the kind described above.

Figure 4:
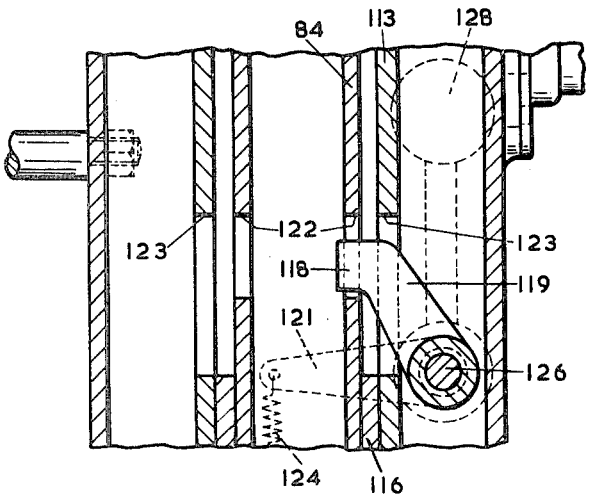
FIG. 4 is a part sectional end elevation taken on the line 4—4 in FIG. 3.
Figure 3:
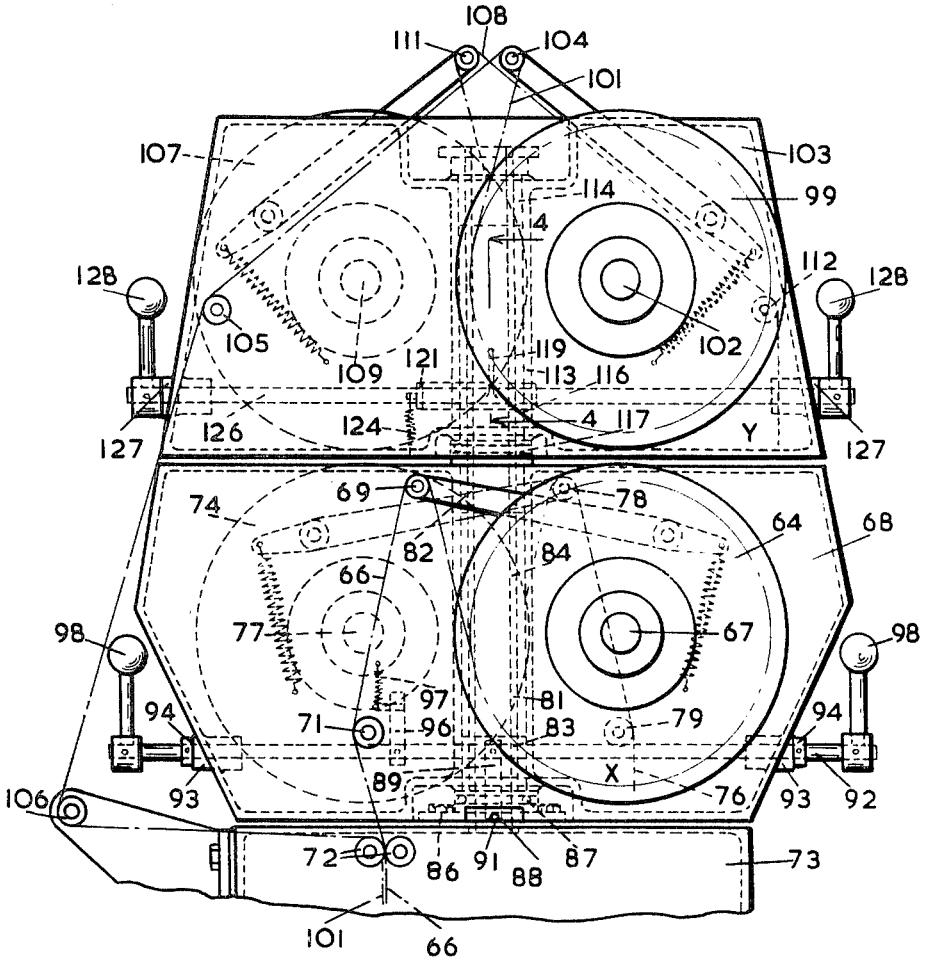
FIG. 3 is an elevation illustrating the other embodiment.

The embodiment of the invention, illustrated in FIGS. 3 and 4, provides for wrapping sweets with an inner wrapping and also an outer wrapping. Since in this case two separate webs have to be fed to the feed rollers and it is most unlikely that both webs will become exhausted simultaneously it is necessary to provide a duplicate web changing facility.

A reel 64 carrying a web 66 of outer wrapping material is mounted on a shaft 67 which extends from one side of a lower support 68. The web 66 passes from the reel 64 over a tension roller 69 and a guide roller 71 towards the nip of a pair of driven feed rollers 72, rotatably mounted in the machine frame 73, which feed the web 66 towards a cutting device (not shown), which severs successive outer wrappers from the web.

A stand-by reel 74 carrying a web 76 of outer wrapping material is mounted on a shaft 77 extending from the opposite side of the support 68, the web 76 (shown in chain line in FIG. 3) being threaded over tension and guide rollers 78 and 79, respectively, with its leading edge positioned at a draw-off point X adjacent the base of the support 68.

The support 68 if formed with a central hub 81 mounted by upper and lower bearings 82 and 83, respectively, on a tubular spigot 84 formed at its lower end with a flange 86 secured to the frame 73. The lower face of the hub 81 rests on a thrust bearing 87 supported on the upper surface of the flange 86, the lower surface of the support 68 being clear of the upper surface of the frame 73 so that the support 68 is capable of rotation on the spigot 84 when desired.

The support 68 is normally locked against rotation by a peg 88, secured to an arm 89, which engages one of a pair of diametrically opposed apertures 91 in the flange 86. The arm 89 is secured to a shaft 92, which carries hand knobs 98 at its ends and is mounted in bearings 93 at the opposite ends of the support 68, the shaft carrying collars 94 which retain it in correct alignment in the support 68. Also secured to the shaft 92 is another arm 96 and a spring 97 extends between the arm 96 and the support 68. The spring 97 urges the peg 88 into the aperture 91.

A reel 99 carrying a web 101 of inner wrapping material is mounted on a shaft 102 which extends from one side of an upper support 103. The web 101 passes from the reel over a tension roller 104 and guide rollers 105 and 106 to the nip of the feed rollers 72 where it comes into contact with the outer web 66 to be fed with that web towards the cutting device, the roller 106 being so positioned as to guide the inner web 101 clear of the rotational path of the lower support 68, prior to passage of the inner web 101 into contact with the outer web 66. The inner web 101 is thus clear of the path of the lower support 68 so that the supports 68, 103 may be independently rotated with respect to the machine frame 73.

A stand-by reel 107 carrying a web 108 of inner wrapping material is mounted on a shaft 109 extending from the opposite side of the support 103, the inner web 108 being threaded over tension and guide rollers 111 and 112 respectively as shown in chain line in FIG. 3, with its leading edge positioned at a draw-off point Y adjacent the base of the upper support 103.

The upper support 103 is formed with a central hub 113 mounted by upper and lower bearings 114 and 116, respectively, on the tubular spigot 84. The lower face of the hub 113 rests on a thrust bearing 117 supported on the upper surface of the lower support 68, the lower surface of the upper support 103 being clear of the upper surface of the lower support 68 so that the upper support 103 is capable of rotation on the spigot 84 when desired.

The upper support 103 is locked against rotation by engagement of a projection 118 (FIG. 4), formed on one arm 119 of a two-armed lever 119, 121, with one of a pair of diametrically opposed slots 122 in the tubular spigot 84, slots 123 being formed in the hub 113 to allow passage and movement of the arm 119. A spring 124, extending between the arm 121 and the support 103, urges the projection 118 into engagement with the slot 122. The two-armed lever 119, 121 is secured to a shaft 126, mounted in bearings 127 formed on the support 103 and carrying hand knobs 128 at its ends.

Upon expiry of the web 66 from the reel 64, the machine is automatically stopped as described above, the peg 88 released from the aperture 91 by manual operation of one of the knobs 98, the lower support 68 is rotated manually through 180° to bring the stand-by reel 74 into position to feed its web 76 to the feed rollers 72 and the support 68 is re-locked by the peg 88. Similarly, upon expiry of the web 101 from the reel 99, the machine is automatically stopped, the projection 118 is released from the slot 122 by manual operation of one of the knobs 128, the upper support 103 rotated through 180° to bring the stand-by reel 107 into position to feed its web 108 to the feed rollers 72 and the support 103 is re-locked in position by the projection 118. Immediately after a reel changing operation is completed, the machine may be re-started to allow wrapping of the sweets to continue. During the continued wrapping operation, the operator can remove the core of the respective exhausted reel, replace it by a new reel and rethread the web from the new reel in readiness for the next reel changing operation.

What we claim as our invention and desire to secure by Letters Patent is:

1. A wrapping machine comprising a machine frame, a wrapping mechanism, a single pair of feed rollers for feeding a web of wrapping material to said wrapping mechanism, and a reel changing device comprising at least one turret rotatably mounted on the machine frame, mountings on the turret for supporting two reels of wrapping material, guiding means mounted on the turret for guiding the wrapping material from the two reels to respective separate and diametrically opposite draw-off points, the turret being rotatable with respect to the machine frame between alternative positions, in one of which the draw-off point of one of said wrapping materials is positioned adjacent said single pair of feed rollers and in the other of which the draw-off point of the other of said wrapping materials is positioned adjacent said single pair of feed rollers, and means for locking the turret to the machine frame in each of its two alternative positions, said mountings extending perpendicular to the axis of rotation of the turret, with one mounting projecting from one side of the turret and the other mounting projecting from the other side of the turret, so that, when wrapping material is being withdrawn from one of said reels by said feed rollers, the other mounting is accessible to enable the wrapping material from the other of said reels placed thereon to be fed through its respective guiding means to its respective draw-off point for use when said one reel is exhausted.

2. A wrapping machine according to claim 1, wherein the turret is mounted for rotation about a vertical axis.

3. A wrapping machine according to claim 2, in which the locking means is manually operable.

4. A wrapping machine according to claim 3, in which the locking means comprises a shaft rotatably mounted in the support, a peg on the shaft which is engageable with alternative apertures in the machine frame, a spring urging the shaft to a position locating the peg in one of said apertures, and a knob on the shaft for rotating it to disengage the peg from the aperture.

5. A wrapping machine according to claim 1, in which the reel changing device includes two turrets which are independently rotatable with respect to the machine frame about a common axis to alternative positions, one of said turrets carrying two reels for alternatively feeding, in accordance with the position of the turret, webs of outer wrapping material to the feed rollers and the other of said turrets carrying two reels for alternatively feeding, in accordance with the position of said turret, webs of inner wrapping material to the feed rollers, and separate locking means for locking each said turret to the machine frame in each of its alternative positions.

* * * * *